US005549057A

United States Patent [19]

Favreau

[11] Patent Number: 5,549,057

[45] Date of Patent: Aug. 27, 1996

[54] DRYER AND COMBUSTIBLE PELLET SYSTEM

[75] Inventor: David J. Favreau, Cedar Springs, Mich.

[73] Assignee: Raymon J. Castine, Belmont, Mich.; a part interest

[21] Appl. No.: 320,914

[22] Filed: Oct. 11, 1994

[51] Int. Cl.[6] ..... F23K 1/00

[52] U.S. Cl. ..... 110/218; 34/165; 34/436; 34/519; 44/634; 44/635

[58] Field of Search ..... 110/218, 224–228, 110/229; 34/165, 167, 168, 519, 520, 436; 44/634, 635, 633

[56] References Cited

U.S. PATENT DOCUMENTS

| | | | |
|---|---|---|---|
| 933,898 | 9/1909 | French . | |
| 2,008,351 | 7/1935 | Diehl . | |
| 2,057,610 | 10/1936 | Diehl . | |
| 4,141,155 | 2/1979 | Benzon . | |
| 4,341,516 | 7/1982 | Eikerman . | |
| 4,424,634 | 1/1984 | Westelaken . | |
| 4,431,405 | 2/1984 | Eatherton . | |
| 4,502,229 | 3/1985 | Kitzman . | |
| 4,530,700 | 7/1985 | Sawyer . | |
| 4,692,167 | 9/1987 | Levasseur | 44/635 |
| 4,702,746 | 10/1987 | Finch | 44/634 |
| 4,746,404 | 5/1988 | Laakso | 34/168 |

FOREIGN PATENT DOCUMENTS

| | | | |
|---|---|---|---|
| 0117880 | 5/1991 | Japan | 34/165 |
| 3211386 | 9/1991 | Japan | 34/168 |
| 6058667 | 3/1994 | Japan | 34/167 |

*Primary Examiner*—Thomas E. Denion

*Attorney, Agent, or Firm*—Price, Heneveld, Cooper, DeWitt & Litton

[57] ABSTRACT

A dryer for particulate materials comprising an elongated, peripherally enclosed combustion tunnel having a combustion chamber and an exhaust outlet, a liner spaced from and around the combustion tunnel, having an exterior radiant heat reflective shield, a peaked upper roof portion defining a pair of diagonal, flow dividing, slide surfaces, the upper roof portion being of a metal alloy having a low coefficient of friction and high thermal conductivity, a jacket surrounding and generally spaced from the liner, cooperative with the liner to form a material drying chamber between the liner and jacket, the jacket having a configuration similar to that of the liner and an interior heat reflective shield, an elongated, particulate material inlet conveyor in the housing above the upper roof portion of the liner for dispensing particulate material over the length of the roof portion to evaporate volatilizable substances therefrom, an elongated, particulate material discharge conveyor in the jacket, beneath the liner, for discharging particulate material from which volatilizable substances have been removed, and an upper discharge passage from the drying chamber for discharge of volatilizable substances.

18 Claims, 3 Drawing Sheets

DRYER AND COMBUSTIBLE PELLET SYSTEM

BACKGROUND OF THE INVENTION

This invention relates to a combustible pellet forming system and to a dryer therefor, particularly a dryer having the capability of driving off volatilizable substances from particulate materials such as wood chips, sawdust, ground leaves and the like, condensing and retaining these substances. It is also useful as a kiln for lumber.

Disposal of organic substances such as tree branches and leaves has been given serious consideration in recent years, partially because of increasingly limited landfill space available, restrictions on residential burning of leaves, etc. One technique used to process tree branches is to chip them into pieces. A small percentage of these wood chips and leaves is presently used for mulch. Another portion of the wood chips is used to power generators of electricity in large commercial/industrial units. Still, there remains a tremendous amount of chips and leaves which cannot presently be used for these purposes. Some cities have resorted to paying significant sums to have such materials hauled away and composted. While this is a commendable practice, it is expensive and certainly not a total solution.

Another costly factor experienced by persons living in colder climates such as the northern part of the United States, and elsewhere, is the purchase of fuel including natural gas, propane gas, fuel oil and wood. In the past, wood for fuel has been largely in the form of cord wood, i.e., large pieces which are cut, split and manually handled. An alternative to this is the growing use of uniform size, compressed wood pellets which can be manually or automatically fed into a special stove or stoker furnace built to accommodate the pellets. However, for such pellets to be the most efficient, the moisture contained by the pellets should be low. Hence, there is need for efficient drying. As to leaves, of which there is an abundance every autumn, a substantial share of these have found no market at all, such that they largely constitute a nuisance for which disposal is costly.

Another use of dryers where fuel consumption is substantial is the drying of farm food products such as grain and corn. The fuel required is substantial and costly with present equipment.

SUMMARY OF THE INVENTION

One object of this invention is to provide a system and apparatus for processing particulate material such as wood chips, sawdust and ground leaves to produce a useful product in the form of combustible compact pellets. The pellets can be sold for use as fuel in wood pellet stoves and stoker furnaces, or can power electrical generators.

Another object of this invention is to provide a special dryer which is specially suited for drying particulate materials such as wood chips, sawdust and ground leaves, or several other products such as grain, corn and other farm products. The dryer comprises a continuous processor of particulate materials, serving to drive off volatilizable substances including organic compounds and water. The dryer has a hot gas tunnel surrounded by and spaced from a dryer housing which has an interior product support liner and an exterior product retention jacket of different size, but generally of comparable configuration to each other. Both the exterior surface of the product support liner and the interior surface of the product retention jacket have highly heat reflective and high heat conductive characteristics. These surfaces may be constructed of interconnected modular panels of a material which readily conducts heat to a uniform overall temperature. These panels serve as a shield to radiate heat into the drying chamber. The combined effect of radiant heat, mass of the material and arrangement of the components creates an efficiency that enables the dryer to effectively function on a significantly smaller amount of fuel than those of which the inventor is aware. Moreover, the type of fuel used is widely variable, so as to suit the location and circumstances involved, as explained more fully herein. The fuel exhaust fumes do not contact the product being dried, rendering the dryer particularly effective for food materials such as farm grain products.

The dryer is equipped with several safety devices to assure safety of operation.

The product support liner has an upper roof portion that is peaked, defining a pair of downwardly-outwardly extending, diagonal slide surfaces for product support and movement thereover to discharge down alongside a pair of vertical side walls of the product support liner. The bottom of the liner preferably has a pair of walls which converge diagonally toward each other, generally above a discharge conveyor auger in the dryer housing. Above the peak of the hot gas tunnel, along the length of the housing, is an infeed conveyor auger which discharges particulate material down into the dryer housing along the length of the housing.

Conceivably, the dryer could also be employed to dry lumber, in the nature of a lumber kiln, in a batch type process, by providing inlet/outlet openings in one end of the housing and providing support racks inside the housing.

These and several other objects and advantages of the invention will become apparent upon studying the following specification in conjunction with the drawings.

DESCRIPTION OF THE PREFERRED EMBODIMENT

Figure 1:
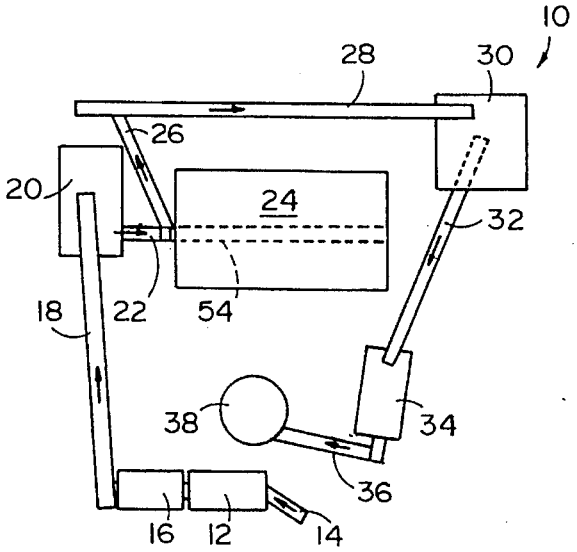
FIG. 1 is a plan schematic view of the system disclosed herein.
Figure 6:
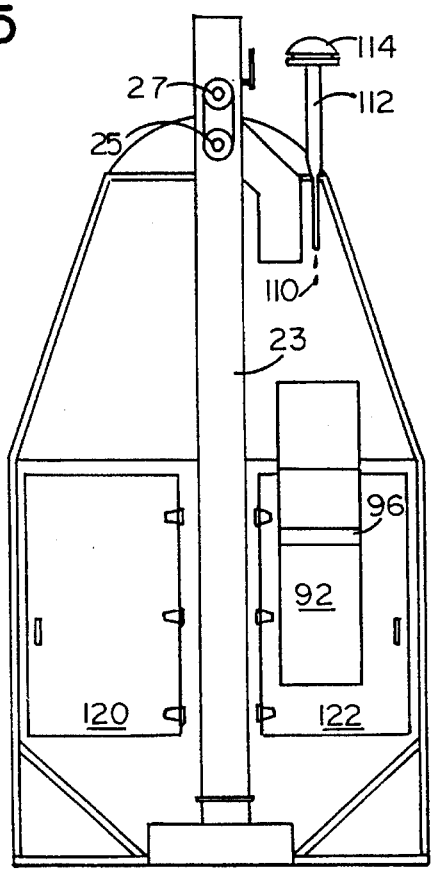
FIG. 6 is an end elevational view of the dryer taken from the left end of the structure as viewed in FIG. 2.

Referring now specifically to the drawings, the pellet system 10 in FIG. 1 is shown to include a pulverizer 12 such as a hammer mill having an infeed conveyor 14 thereto, a discharge shaker 16 of conventional type to separate oversized pieces from properly pulverized pieces so as to recycle the oversized pieces, and a transfer conveyor 18 from the shaker to a first hopper 20. A transfer conveyor 22 provides a controlled feed from hopper 20 to the lift conveyor 23 (FIG. 6) to the top of the dryer 24. The product, after drying, emerges from the bottom of dryer 24 and is transferred by conveyor 26 to another conveyor 28 which conveys the dried particulate material to a second hopper 30. A transfer conveyor 32 extends from hopper 30 to a pelletizer 34. The resulting pellets are moved by a transfer conveyor 36 to a third hopper, a storage hopper 38, from whence the final product can be removed as needed. The novel dryer is shown in more detail in FIGS. 2–6.

Dryer 24 has a generally upright housing 50. This housing comprises an outer, product retention jacket 51, an interior product support liner 60, and a hot gas tunnel 68. Between jacket 51 and support liner 60 is defined a drying chamber 100. The outer jacket in cross section has a pair of opposite, vertical side walls 50*a* (FIG. 4), a domed top including a slightly rounded peak 50*b*, and a pair of roof panels 50*c* extending downwardly and diagonally outwardly away from each other and from this peak to thereby join side walls 50*a* to dome 50*b*. The jacket also has a pair of end walls 50*d* and 50*e*. The bottom of the jacket is shown to include a pair of downwardly, diagonally-inwardly oriented panels 50*f* astraddle a central, horizontal bottom panel 50*g*, to thereby form a trough arrangement extending longitudinally of the housing. A discharge conveyor, preferably a helical auger conveyor 51, is mounted longitudinally in and along the bottom of the trough to remove dried particulate materials from the housing in a manner to be described hereinafter.

Figure 2:
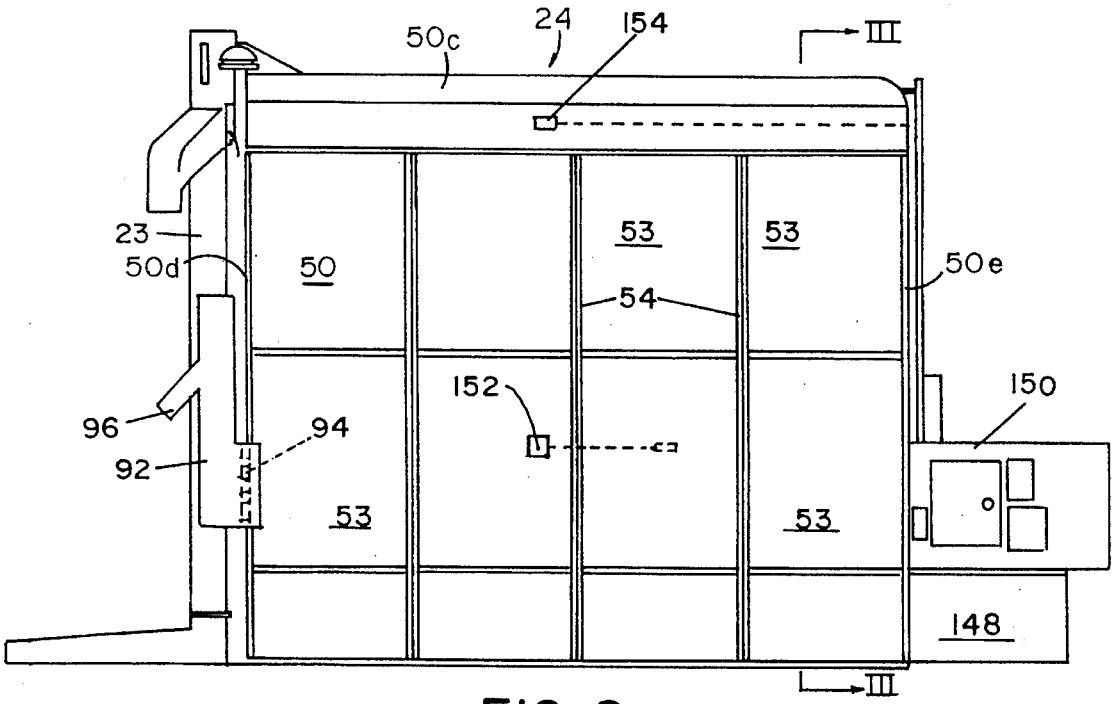
FIG. 2 is a side elevational, sectional view of the novel dryer forming part of the system in FIG. 1.
Figure 3:
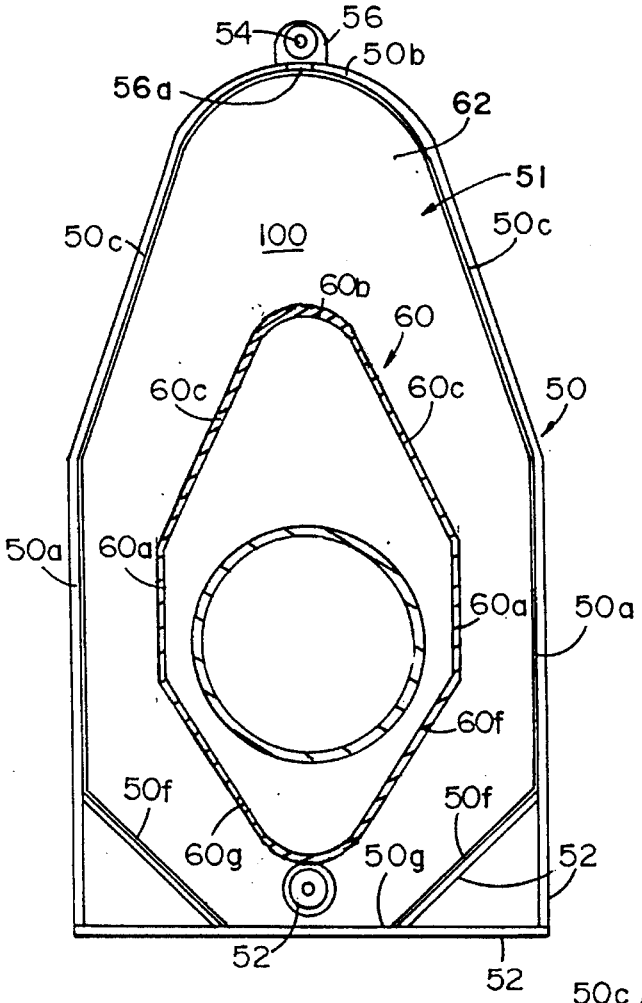
FIG. 3 is a sectional-view taken on plane III—III of FIG. 2.

The inner surface of outer jacket 51 has a special heat shield including high radiant heat reflectivity, and high heat conductivity. This inner surface shield is formed of a plurality of interconnected metal panels 53 bolted together at edges 54 (FIG. 2). The preferred material is an alloy developed for aerospace projects, known by the tradename DARPA, and being a titanium/aluminum alloy. It is available from Timet Corporation in Henderson, Nev., U.S.A. The composition is, by weight, about 55% titanium, about 34% aluminum, about 3% vanadium, and about 8% titanium Boride ($TiB_2$). This material is about 1/16 inch thick. Alternatively, and less preferred, the inner surface could be of what is known in the trade as heavy aluminum or a metal such as stainless steel. The high heat conductivity causes the shield to have an overall uniform temperature. The high radiant heat reflectivity causes heat to remain in the drying chamber, especially in cooperation with a similar shield on the exterior of liner 60 to be described hereinafter.

Extending along the length of the top of the housing is a feed conveyor 54 preferably in the form of an auger inside its elongated, cylindrical tube 56. Suitable bottom openings 56*a* along the length of tube 56 enable the auger to drop feed particulate materials to be dried down along the length of the dryer housing for optimum distribution into the drying chamber. The feed auger and discharge auger are powered by an electric motor (not shown) and any suitable drive and pulley connection arrangement such as those depicted at 58 and 59 in FIG. 4.

Inside the housing jacket is the elongated product support liner 60 which is smaller than and spaced from the jacket 51 but has a configuration generally similar to that of the jacket. It is heated by convection and radiant heat from the combustion tunnel 66 which is spaced inwardly therefrom. This jacket configuration includes an upper domed or peaked roof 60*b*, a pair of diagonally, downwardly-outwardly extending, sloped top walls 60*c* from the dome down to a pair of vertical side walls 60*a* which terminate at their lower ends in a pair of diagonally-downwardly convergent bottom panels 60*f* which end in a lower curved bottom 60*g* in the center of the housing bottom. Discharge conveyor auger 52 is directly below the liner bottom 60*g*, i.e., between it and the bottom surface 50*g* of jacket 50. This metal liner 60 has an outer surface of a material having a low coefficient of friction so that damp particulate material dropped along its length will slide down the tunnel while being dried. It also has a reflective heat shield comparable to the heat shield on the interior of housing 51, characterized by a high coefficient of thermal conductivity and high radiant heat reflectivity, with the result that, in combination with the jacket, heat is generally uniformly dissipated over the surface area and over the drying chamber space for drying materials flowing down over the liner from the top infeed auger to the bottom discharge auger. Again, the material found to be particularly useful for this is the titanium/aluminum alloy manufactured by Timet Corporation, Henderson, Nev., known as DARPA. The alloy most preferred is composed of, by weight, about 55% titanium, about 34% aluminum, about 3% vanadium, and about 8% titanium boride. An alternative, less preferred material would be another alloy such as heavy aluminum or stainless steel. The opposite ends 60*d* and 60*e* of liner 60 (FIG. 5) close off the chamber except for exhaust gas discharge facilities in end 60*d*, and combustion chamber apparatus in end 60*e*, both to be explained more fully hereinafter. The liner is provided with the special exterior shield surface by having panels of the type shown in FIG. 2, interconnected with each other.

Figure 4:
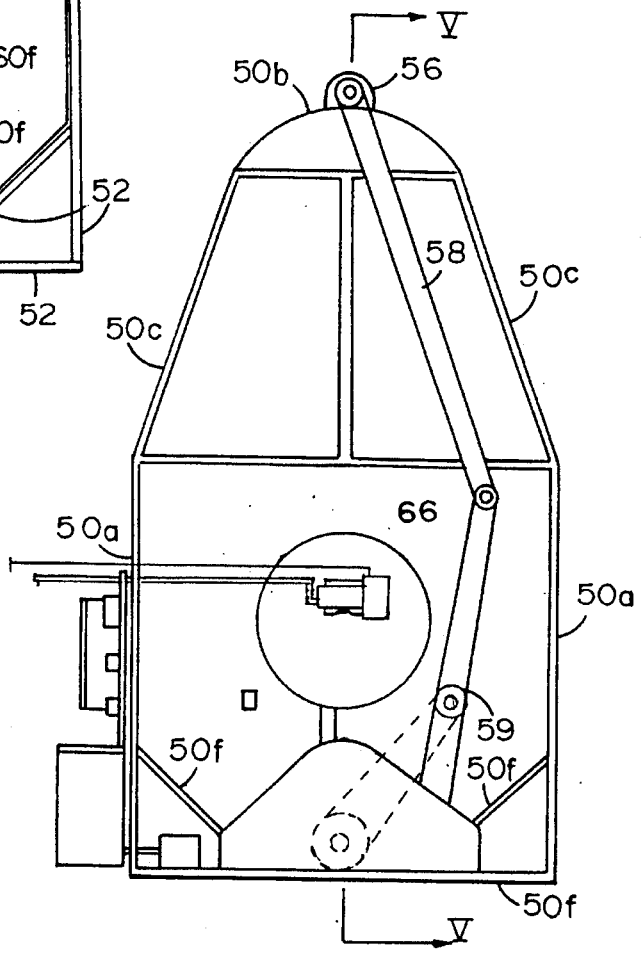
FIG. 4 is an end elevational view of the dryer taken from the right end of the dryer in FIG. 2.
Figure 5:
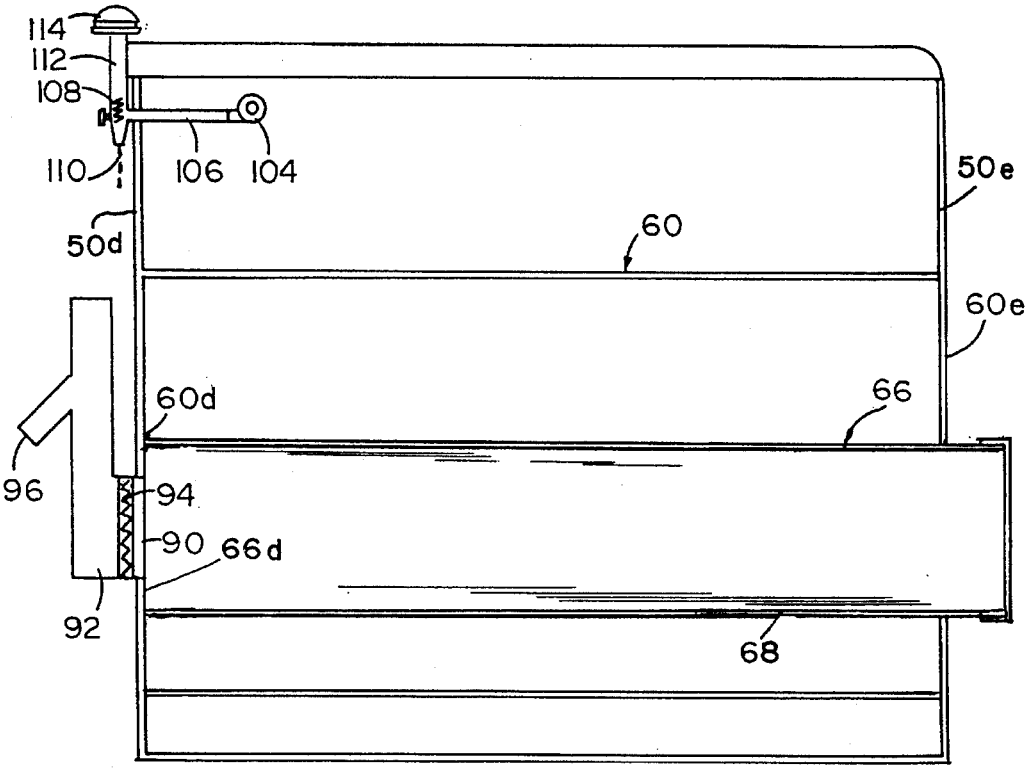
FIG. 5 is a sectional view taken on plane V—V of FIG. 4.

Located within and spaced from liner 60 is the elongated combustion tunnel 66 shown in its preferred cylindrical configuration. It is shown to extend from end to end of the liner 60, dryer chamber 100 and jacket 51. FIG. 4 depicts the combustion tunnel with its end cap removed to show the combustion gas fuel burner and liquid fuel burner system, the latter having an adjustable fuel nozzle to burn a variety of liquid fuels. This burner system preferably has a plurality of different type burner units for accommodating any of a variety of fuels. This combustion chamber can be operated either with fuels which are purchased on the open market, for which a suitable fuel tank 148 is provided (FIG. 2), or optionally can be operated with combustible organic materials such as alcohols obtained from volatilization of substances in the material being dried, e.g., methanol or wood alcohol from wood chips, ethanol or grain alcohol from grain products, depending upon the drying temperature, so that the dryer can be at least partially self sustaining. In some instances only moisture will be volatilized, e.g., from leaves, such that the resulting water is of course not combustible but may be discharged directly. At end 66*d* of the combustion tunnel is an outlet opening 90 to a discharge conduit 92, preferably a filter 94 (FIG. 5), and an outlet 96 for controlled discharge of exhaust gases. The high temperature tunnel 66 is spaced from liner 60 sufficiently that the temperature of liner 60 and its special surface are uniformly heated at a temperature not exceeding about 250° F.

As noted previously, the space between jacket 51 and liner 60 comprises the drying chamber 100. This drying chamber extends from above liner 60, around the side walls thereof and beneath the bottom thereof. The particulate material is dispensed vertically over the axial length of the dryer housing, to drop onto dome 60*b* of the liner over the length thereof. The material flows down along the diagonal walls 60*c*, 60*a* and 60*f*, and along housing walls 50*c*, 50*a* and 50*f*, to the bottom 50*g* of the housing where discharge auger 52 removes it at a controlled rate from the dryer to transfer conveyor 26. The discharge is controlled from a control panel 150 (FIG. 2), which is responsive to a thermostat 152 in the housing and a humidistat 154 at the top of the housing. The volatilized components from the particulate material in the drying chamber are removed by fan 104 and flow through conduit 106 to an external condenser 108 in the discharge system. The liquid condensate flows down through outlet 110 to a suitable container while the gaseous components flow upwardly in conduit 112 to a filter unit 114, and thence to the atmosphere or other discharge chamber, as desired.

Safety devices preferably include a 360° F. fire eye sensor to an alarm system, a fire extinguisher with a nozzle inside the drying chamber and set with a 340° F. fusible link, and high and low pressure limit switches for gas fuel. Additional safety equipment can be employed, if desired.

In operation, the oven is first preheated for a short time period to assure uniform temperature of about 250° F. on the exterior surface of liner 60 and interior surface of jacket 51. Then, materials such as wood chips, sawdust, leaves, grain or the like are delivered to pulverizer 12, if necessary to pulverize them, via conveyor 14 where they are pulverized into smaller particles which are separated by shaker 16, and when of proper size are loaded onto conveyor 18 to the first hopper 20. From thence they flow via conveyor 22 to the lift conveyor 23 (FIG. 6) operated through a suitable pulley 25 from a power source. This power source may also operate a drive sprocket or pulley 27 (FIG. 6) to the feed auger 54 which drops particulate material along the length of the dryer housing, onto the length of the heated liner roof **60*b* therebelow. The particulate material slides, i.e., advances, down both sides of this metal roof structure in the drying chamber to ultimately be dried by the time it reaches the base of the housing. This drying is effected by heat from combustion tunnel 66, this heat being uniformly distributed throughout the length of the drying chamber by the high heat conductivity metal shields on the liner and jacket. The heat that is radiated out to the walls is generally uniformly dissipated to assist in the drying process. The dried particulate material is discharged via conveyor auger 52, while the volatilized substances and accompanying gaseous materials driven off from the particulate material are discharged through conduit 106 and separated into condensate and gas at condenser 108**. Therefore, the fuel to be burned in the combustion chamber may be at least in part obtained from the volatilized substances, e.g., alcohol.

The particulate materials discharged from the dryer onto transfer conveyors 26 and 28 or the like move on to hopper 30, for example, from whence they can move via conveyor 32 to a pelletizer 34, if desired. The resulting pellets may be transferred on conveyor 36 to a storage hopper 38. Obviously, these items which supplement the dryer can vary widely without departing from the invention.

As a consequence of this apparatus, particulate materials such as wood chips, sawdust, grain, leaves and other materials can be readily handled at a substantial savings, generating useful products, for example, combustible pellets which can be burned economically in a pellet stove, in stoker furnaces, for commercial heating and/or power generation, and the like. The novel apparatus requires only a small fraction of the heat required to operate previously known drying apparatus.

Conceivably the novel dryer could also be employed for drying lumber. In such an instance, doors 120 and 122 (FIG. 6) at one end of the dryer could be opened for insertion and removal of lumber. Suitable support racks (not shown) could be positioned in the drying chamber for supporting the lumber in spaced relationship for optimum drying.

Those skilled in this art may conceive of several variations in the apparatus disclosed, e.g., to suit a particular installation, type of product, type of fuel, etc. Hence, the invention is not intended to be limited to just the specific preferred embodiment set forth, but only by the appended claims and the reasonably equivalent apparatus to that defined therein.

The embodiments of the invention in which an exclusive property or privilege is claimed are defined as follows:

1. A dryer for particulate materials comprising:

an elongated, peripherally enclosed combustion tunnel having a combustion chamber and an exhaust outlet;

an enclosing liner spaced from and around said combustion tunnel, having heat shield slide surfaces of a metal alloy having a low coefficient of friction and high thermal conductivity;

a jacket surrounding and generally spaced from said liner having an interior heat shield and cooperative with said liner for forming a material drying chamber between said liner and said jacket such that fuel exhaust fumes do not contact the material being dried;

a material inlet conveyor in said jacket above said liner for dispensing particulate material over said liner to evaporate volatilizable substances therefrom;

a particulate material discharge conveyor beneath said liner for discharging particulate material from which volatilizable substances have been removed; and an upper discharge passage from said drying chamber for discharge of volatilizable substances.

2. The dryer in claim 1 including a condenser in said upper discharge passage to condense said volatilizable substances.

3. The dryer in claim 1 wherein said liner has a high heat conduction outer surface of titanium/aluminum alloy.

4. The dryer in claim 3 wherein said jacket has a high heat conduction inner surface of titanium/aluminum alloy.

5. The dryer in claim 3 wherein said titanium/aluminum alloy has a composition comprising, by weight, about 55% titanium, about 34% aluminum, about 3% vanadium, and about 8% titanium boride.

6. The dryer in claim 1 wherein said liner has diagonal flow dividing slide surfaces, a pair of vertical side wall surfaces, and a pair of downwardly, inwardly diagonally sloping bottom surfaces sloping toward each other and joined above said discharge conveyor.

7. A processing system for making combustible pellets, comprising:

a disintegrator for disintegrating leaves and wood into smaller particles;

a dryer as claimed in claim 1;

a first transfer conveyor from said disintegrator to said dryer for transferring particulate materials to said dryer;

a pellet former downstream of said dryer; and a second transfer conveyor from said dryer to said pellet former.

8. The system in claim 7 wherein said jacket has a configuration generally like that of said liner.

9. A dryer for particulate materials comprising:

an elongated, peripherally enclosed combustion tunnel having a combustion chamber and an exhaust outlet;

a liner spaced from and around said combustion tunnel, having a peaked upper roof portion defining a pair of diagonal, flow dividing, slide surfaces;

said upper roof portion being of a metal alloy having a low coefficient of friction and high thermal conductivity;

a jacket surrounding and generally spaced from said liner, forming a material drying chamber between said liner and said jacket and constructed such that fuel exhaust fumes do not contact the material being dried;

said jacket having a configuration similar to that of said liner;

an elongated, particulate material inlet conveyor in said jacket above said upper roof portion of said liner for dispensing particulate material over the length of said roof portion to evaporate volatilizable substances therefrom;

an elongated particular material discharge conveyor in said jacket, beneath said liner, for discharging particulate material from which volatilizable substances have been removed; and an upper discharge passage from said drying chamber for discharge of volatilizable substances.

10. The dryer in claim 9 including a condenser in said upper discharge passage to condense said volatilizable substances.

11. The dryer in claim 9 wherein said liner has a high heat conduction outer surface of titanium/aluminum alloy.

12. The dryer in claim 11 wherein said jacket has a high heat conduction inner surface of titanium/aluminum alloy.

13. The dryer in claim 11 wherein said titanium/aluminum alloy has a composition comprising, by weight, about 55% titanium, about 34% aluminum, about 3% vanadium, and about 8% titanium boride.

14. The dryer in claim 9 wherein said liner has, in addition to said diagonal flow dividing slide surfaces, a pair of vertical side wall surfaces, and a pair of downwardly, inwardly diagonally sloping bottom surfaces sloping toward each other and joined above said discharge conveyor.

15. A processing system for making combustible pellets, comprising:

a disintegrator for disintegrating leaves and wood into smaller particles;

a dryer as claimed in claim 9;

a first transfer conveyor from said disintegrator to said dryer for transferring particulate materials to said dryer; and a second transfer conveyor from said dryer to said pellet former.

16. The system in claim 15 wherein said dryer includes a condenser in said upper discharge passage to condense said volatilizable substances.

17. The system in claim 16 wherein said titanium/aluminum alloy has a composition comprising, by weight, about 55% titanium, about 34% aluminum, about 3% vanadium, and about 8% titanium boride.

18. The system in claim 9 wherein the dryer tunnel has, in addition to said diagonal flow dividing slide surfaces, a pair of vertical side wall surfaces, and a pair of inwardly diagonally sloping bottom-surfaces sloping toward each other and joined above said discharge conveyor.

* * * * *